US006145206A

United States Patent [19]

Piccirillo

[11] Patent Number: 6,145,206

[45] Date of Patent: Nov. 14, 2000

[54] BUCKING AND WRAPPING GAUGE FOR WINDOW INSTALLATION

[75] Inventor: Gary C. Piccirillo, Jupiter, Fla.

[73] Assignee: Wizard Tools and Construction Materials, LLC, Jupiter, Fla.

[21] Appl. No.: 09/344,662

[22] Filed: Jun. 25, 1999

Related U.S. Application Data

[60] Provisional application No. 60/090,850, Jun. 26, 1998.

[51] Int. Cl.[7] ..... E04F 21/00

[52] U.S. Cl. ..... 33/194; 33/474; 33/533; 33/549

[58] Field of Search ..... 33/194, 526, 533, 33/535, 645, 549, 562, 563, 565, 566, 613, 474–481, 482

[56] References Cited

U.S. PATENT DOCUMENTS

| | | | |
|---|---|---|---|
| 303,666 | 8/1884 | Ritchie | 33/419 |
| 481,245 | 8/1892 | Ritterbeck . | |
| 493,566 | 3/1893 | Steedman . | |
| 2,461,783 | 2/1949 | Stark | 33/481 |
| 2,759,268 | 8/1956 | Cook . | |
| 4,502,232 | 3/1985 | Broders | 33/479 |
| 4,947,594 | 8/1990 | Theobald et al. . | |
| 4,999,922 | 3/1991 | Loggins | 33/474 |
| 5,090,129 | 2/1992 | Cunningham | 33/474 |
| 5,123,172 | 6/1992 | Thrun . | |
| 5,535,523 | 7/1996 | Endris | 33/474 |
| 5,604,988 | 2/1997 | Costelloe . | |
| 5,655,330 | 8/1997 | Parsons, III | 33/562 |

*Primary Examiner*—Andrew H. Hirshfeld
*Attorney, Agent, or Firm*—Fish & Neave; Michael E. Shanahan

[57] ABSTRACT

A bucking and wrapping gauge suitable for installing windows is provided. The bucking portion of the gauge provides a constant setback distance for a window buck relative to outer edge of a window opening without using a ruler or other measurement tool. The wrapping portion of the gauge provides a constant wrapping distance that partially compensates for the thickness of the window buck so that it may be determined where to install an interior wall relative to a window frame so that a window wrap and the interior wall abut at a substantially right angle. The wrapping and bucking gauge may be implemented as a separate wrapping gauge and bucking gauge.

12 Claims, 5 Drawing Sheets

BUCKING AND WRAPPING GAUGE FOR WINDOW INSTALLATION

This application claims the benefit of U.S. provisional application No. 60/090,850, filed Jun. 26, 1998.

BACKGROUND OF THE INVENTION

This invention relates to windows. More particularly, this invention relates to aligning and installing window assemblies in commercial and residential buildings.

In the construction industry, it is a standard practice to provide "roughed in" openings within the basic structural framing of a building for the installation of pre-fabricated window assemblies. Such openings usually have an inside width which exceeds the outer dimensions of the window assembly. Accordingly, the window assembly has to be aligned in the opening with respect to three orthogonal axes prior to being secured therein. It is generally desirable to align the axes of the window assembly so that they are substantially parallel to the corresponding axes in the window opening. This allows the window to be installed flush with respect to the inner surfaces of the window opening. If the window is installed at some angle with respect to the window opening, water leaks and/or air leaks may develop.

A common technique used to install windows within the roughed opening is known as "bucking" the window. This includes installing pieces of material known as "window bucks" inside the window opening to compensate for the difference between the width of the window opening and the dimensions of the window assembly. For proper window installation, the window bucks need to be placed a predetermined distance (known as the "setback distance") from the outer edge of the window opening to provide uniform window sills or "reveals." Additionally, the window bucks should be aligned substantially parallel to axes of the window opening so that the window assembly can be installed square with respect to the interior surfaces of the opening.

One conventional method used for bucking windows involves measuring the setback distance with a ruler or framing square and then drawing a chalk line to mark the position where the window buck should be secured. This method, however, is time consuming and error prone. Another disadvantage is that caulking is usually applied to a bevel on one side of the window buck before it is secured into place in order to prevent window leaks. Thus, as the window buck is being aligned, the caulking may cause it to slide off the chalk line, which may result in inaccurate installation.

Once the window assembly is installed, there is usually a bare space between the interior edge of the window opening and the installed window frame. When the adjacent interior walls are completed, using gypsum wallboard, plaster, or other material, this bare space often appears as an unsightly transition gap between the interior edge of the window and the completed wall. Typically, this space is filled with some form of wallboard or other material to cover this area and provide a consistent surface between the finished interior wall and the window frame. The installation of such material is generally referred to as "wrapping" the window.

It is highly desirable to install such window "wraps" so that they are perpendicular to both the window frame and the finished interior wall. One difficultly encountered when performing this task is that standard-sized wrapping materials have a different thickness than the window bucks used to install the window assembly. Usually, the window buck is thicker than the window wrap. The difference in thickness must be accounted for in order to install the window wrap perpendicular to the interior wall.

A common technique used to compensate for this difference is to extend the interior wall (or a casing structure simulating the position of the interior wall) over the interior window edge an amount approximately equal to the thickness differential. However, this requires a craftsman to know how far over the window edge the interior wall must extend. If the interior wall extends into the window opening too far or not far enough, the resulting window jamb will not be at the desired ninety degree angle.

In the past, many ad hoc methods have been used to wrap windows. One way was to rig a piece of of plywood or other material approximately equal to the thickness of the window wrap and use it as a gauge to align the position of the interior wall. Another way was to use a framing square to measure the thickness needed for the wrap to slip on top of the window frame.

These previously practiced methods all suffer from same basic deficiency. That is, without the assistance of an alignment gauge, the craftsman cannot ensure that the window wrap will be installed perpendicular to both the window frame and the interior wall. Furthermore, if the desired results are not obtained after the first wrap is completed, the craftsman is faced with the problem of rearranging the window wraps after they have been secured in position. Often, while attempting to get the windows wraps removed from their original position so they could be arranged correctly, the wraps would become ripped or damaged.

Thus, in view of the foregoing, it would be desirable to provide a bucking gauge that can accurately provide a predetermined setback distance for aligning and installing window bucks. It would also be desirable to provide a wrapping gauge capable of aligning window wraps substantially perpendicular to both a window frame and an interior wall structure.

SUMMARY OF THE INVENTION

It is therefore an object of the present invention to provide a bucking gauge that can accurately provide a predetermined setback distance for aligning and installing window bucks.

It is another object of the present invention to provide a wrapping gauge capable of aligning window wraps substantially perpendicular to both a window frame and an interior wall structure.

In accordance with these and other objects of the present invention, a bucking and wrapping gauge suitable for installing window assemblies is described. The bucking and wrapping gauge may include a generally L-shaped body portion that has an inner surface configured for installing a window buck at a predetermined setback distance and an outer surface configured for aligning a window wrap at a substantially right angle with respect to major plane substantially parallel to a window opening.

The bucking portion of the gauge includes a bottom arm that establishes a reference point from which a setback distance is measured and a face portion perpendicular to the bottom arm that provides the setback distance. An aperture region adjacent to the face portion is configured to receive a window buck so that when said face portion is brought flush against an inside surface of a window opening and the bottom arm is brought flush against an outside portion of a window opening, the window buck is located a distance from an outside edge of the window opening corresponding to the setback distance.

The wrapping portion of the gauge includes an outer leg and a finger portion configured to be inserted into a buck jamb that holds the gauge in place and establishes a reference point from which a wrapping distance is measured. A top leg portion substantially perpendicular to the outer leg extends out of the window opening so that the top leg portion provides a predetermined wrapping distance that allows a craftsman to determine where to position an interior wall structure relative to the window assembly so that the window wraps, when installed, are at a substantially 90° angle with the interior wall structure. If desired, the bucking and wrapping gauge of the present invention may be implemented as a separate bucking gauge and wrapping gauge.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PREFERRED EMBODIMENTS

Figure 1:
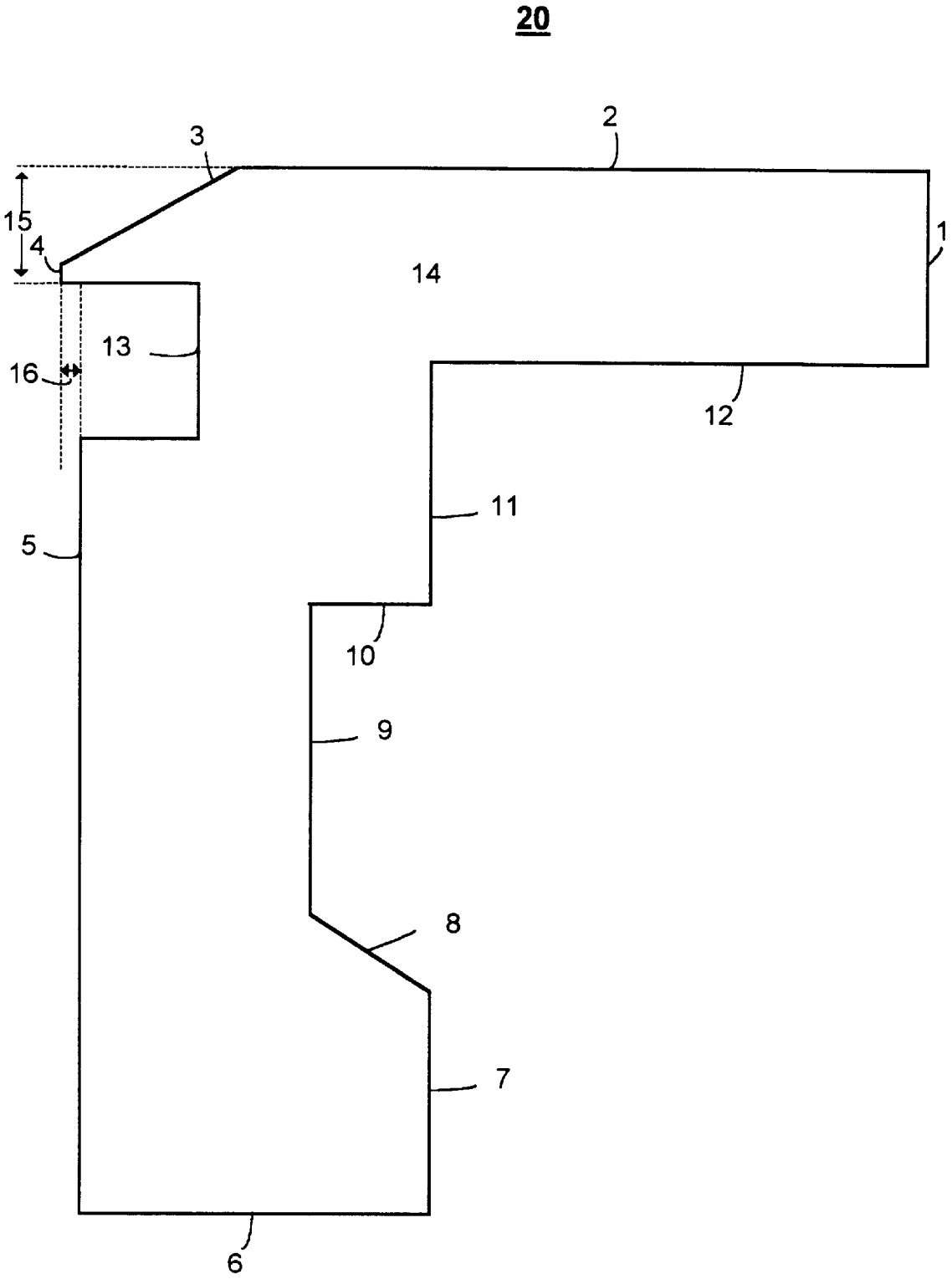
FIG. 1 is an overhead view of one embodiment of the bucking and wrapping gauge of present invention.

An illustrative embodiment of a window bucking and wrapping gauge 20 constructed in accordance with the principles of the present invention is shown in FIG. 1. Starting in the upper right hand corner of FIG. 1 and moving counterclockwise, gauge 20 includes ear 1, top arm 2, nose 3, finger 4, eye 13, outer leg 5, foot 6, inner leg 7, butt 8, back 9, head 10, face 11, and bottom arm 12, and body 14.

Body 14 may be constructed from any relatively thin, semi-rigid material (e.g., a one-quarter inch thick plastic injection molded body) that is firm enough to accept and withstand the weight of bucking and/or wrapping materials being attached to a window opening during the window installation process. Any rigid or semi-rigid material that is suitable as a support structure may be used (e.g., metal, wood, plastic, graphite, fiberglass, plexiglass, etc.).

The inside portion of gauge 20 (i.e., bottom arm 12, face 11, head 10, back 9, butt 8, and inner leg 7) is used to buck a window opening. In one embodiment of the present invention, bottom arm 12 may be about 4.75 inches long, face 11 may be about 2.25 inches long, head 10 may be about 0.75 inches long, back 9 may be about 2.5 inches long, butt 8 may be about 1.0 inch long at angle of about 60 degrees with respect to back 9, and inner leg 7 may be about 2 inches long. This particular embodiment is suitable for wrapping a 25 inch by 25 inch window opening with 0.75 inch window bucks. It will be understood, however, that these dimensions are merely exemplary, and are listed herein only to illustrate one embodiment of the present invention. Persons skilled in the art will understand that sizes other than the ones listed herein may be used to buck window openings of varying dimensions. Such adaptions will be recognized as being within the scope of the present invention.

The purpose of the bucking portion of gauge 20 is to provide the craftsman with an easy way to repeatedly obtain a consistent setback distance (i.e., the distance from an outer edge of the window opening to the outside edge of the window buck) needed for installing a window buck on an interior surface of the window opening. For the example above, this distance is about 2.25 inches (i.e., the length of face 11). It also provides a way to insure that the window buck is aligned substantially parallel to the outside edge of a the window opening. Using gauge 20, a craftsman can quickly install a set of window bucks within a given window opening that are substantially equidistant from and parallel to the outside edge of the window opening. This allows window assemblies to be installed with a consistent set of recessed window sills with respect to the window opening.

Figure 2:
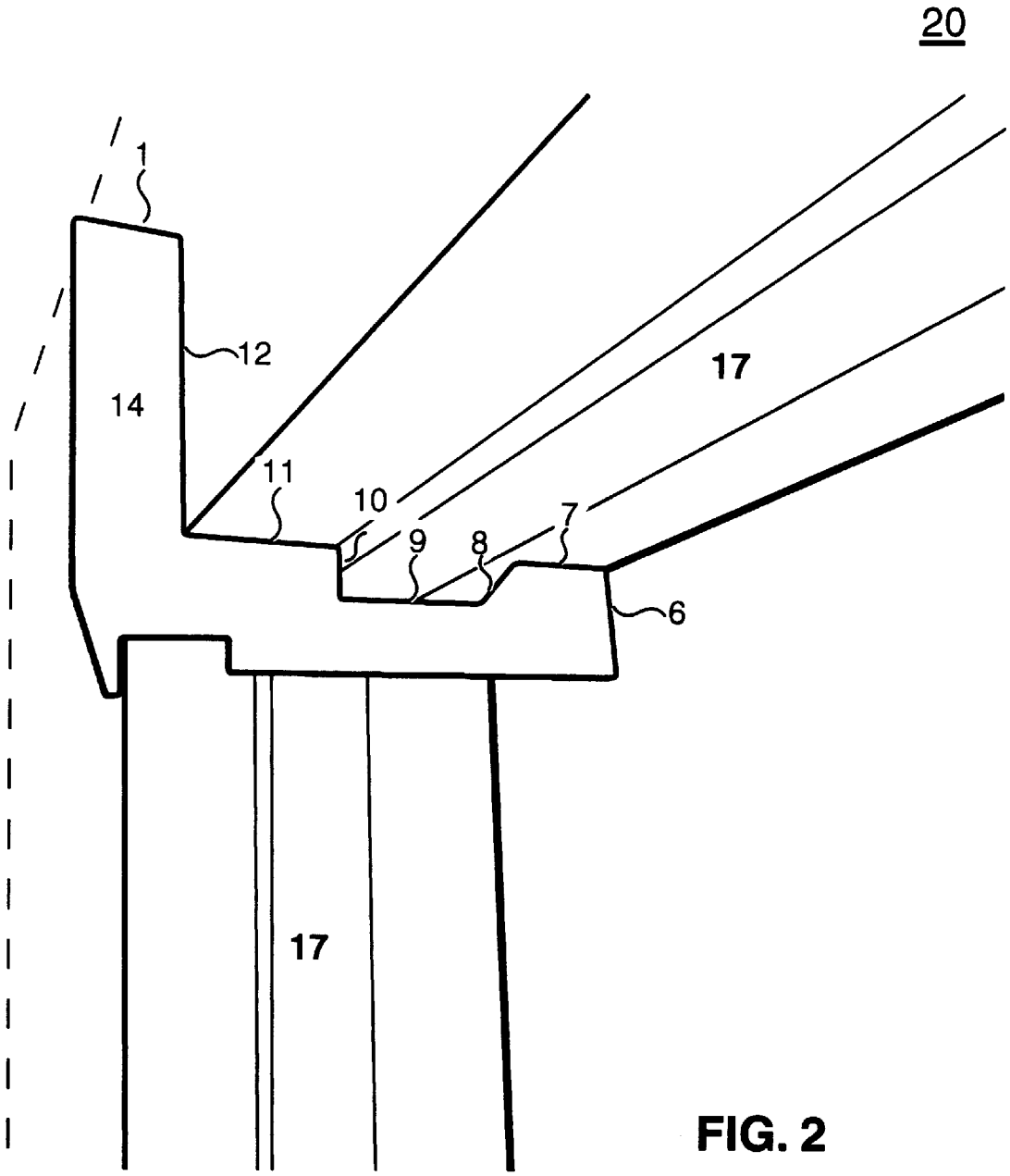
FIG. 2 is side view of the embodiment shown in FIG. 1 being used to buck a window opening.

In general, a craftsman may use gauge 20 as follows. Assume that it is desired to buck a rectangular shaped window opening (although a window of any symmetrical shape may be selected if desired) and that the bucking process begins at the top surface. To start, window buck 17 is placed on the top surface of the window opening. As shown in FIG. 2, a craftsman may take gauge 20 and place an aperture portion formed by butt 8, back 9, and head 10 over the top of window buck 17. Foot 6 should be set facing toward the inside portion of the window opening. If window buck 17 is beveled, it should be oriented so that the beveled end is facing inward toward the angled edge of butt 8. Face 11 and inner leg 7 are then brought flush against the inside surface of the window opening to help hold window buck 17 in place.

Next, bottom arm 12 is placed flush against the outside surface of the window opening. This establishes a reference point from which the setback distance is measured. If necessary, the position of window buck 17 should be adjusted to ensure it fits snugly against head 10. In this position, the length of face 11 supplies a predetermined setback distance (e.g., 2.25 inches) for window buck 17. As long as window buck 17 remains snug against head 10 and bottom arm 12 is maintained flush against the outside surface of the window opening, window buck 17 will be aligned substantially parallel to the edge of the window opening.

At this point, a portion of window buck 17 has been properly oriented and may be secured to the inside of the window opening. This may be accomplished by holding gauge 20 in place with one hand and fastening a portion of window buck 17 adjacent to gauge 20 with the other hand. Window buck 17 may be secured to the window opening using any suitable technique (e.g., using nails, screws, etc.).

Next, the craftsman may slide body 14 to the center or far corner of the window opening, align that portion of window buck 17 as described above, and secure it the window opening. Other portions of window buck 17 may be aligned and secured in a similar fashion. Once this is completed, the top window buck is secured in place. This process may be repeated for the other sides of the window opening (i.e., right, left, and bottom) until all four sides of the opening have been bucked. If desired, additional attachment points may be added to further secure the window bucks to the window opening (e.g., to comply with local building code requirements).

It will be apparent to those skilled in the art that the dimensions of gauge 20 can be adjusted to accommodate a wide variety of installation parameters. For example, the setback distance provided by face 11 can be modified to various lengths for use with window openings and window bucks of different size. The size of the aperture region formed by head 10, back 9, and butt 8 can be varied to accommodate window bucks of different dimensions. The length of bottom arm 12 and inner leg 7 can be modified to for use on window openings of varying size, etc.

The outside portion of gauge 20 (i.e., ear 1, top arm 2, nose 3, finger 4, eye 13, and outer leg 5) is used to wrap a window opening. In one embodiment of the present invention, ear 1 may be about 1.5 inches long, top arm 2 may be about 7.25 inches long (measured from finger 4 to ear 1), nose 3 may be about 1.625 inches long, finger 4 may be about 0.1875 inches long, eye 13 may be about 1.5 inches long and 0.5 inches deep (as measured from outer leg 5), and outer leg 5 may be about 6.75 inches long. This particular embodiment is suitable for wrapping a 25 inch by 25 inch window opening with 0.5 inch wallboard (assuming the window opening has been bucked with standard 0.75 inch window bucks). It will be understood, however, that these dimensions are merely exemplary, and are listed herein only to illustrate one embodiment of the present invention. Persons skilled in the art will understand that sizes other than the ones listed herein may be used to wrap window openings of varying dimensions. Such adaptions will be recognized as being within the scope of the present invention.

The purpose of the wrapping portion of gauge 20 is to provide the craftsman with an easy way to repeatedly obtain a consistent "wrapping distance" (i.e., the distance between an outside edge of window frame 19 to the inner edge of an interior wall or window case 21) needed for installing standard-size wrapping materials around the inside portion of the window opening. For the example above, this distance is about 0.625 inches (i.e., the length from the bottom edge of finger 4 to top arm 2). It also provides a way to insure that the wrapping material is installed substantially perpendicular to the inner edge of an interior wall or window case. This allows window assemblies to be installed with a set of substantially square window sills.

Figure 3:
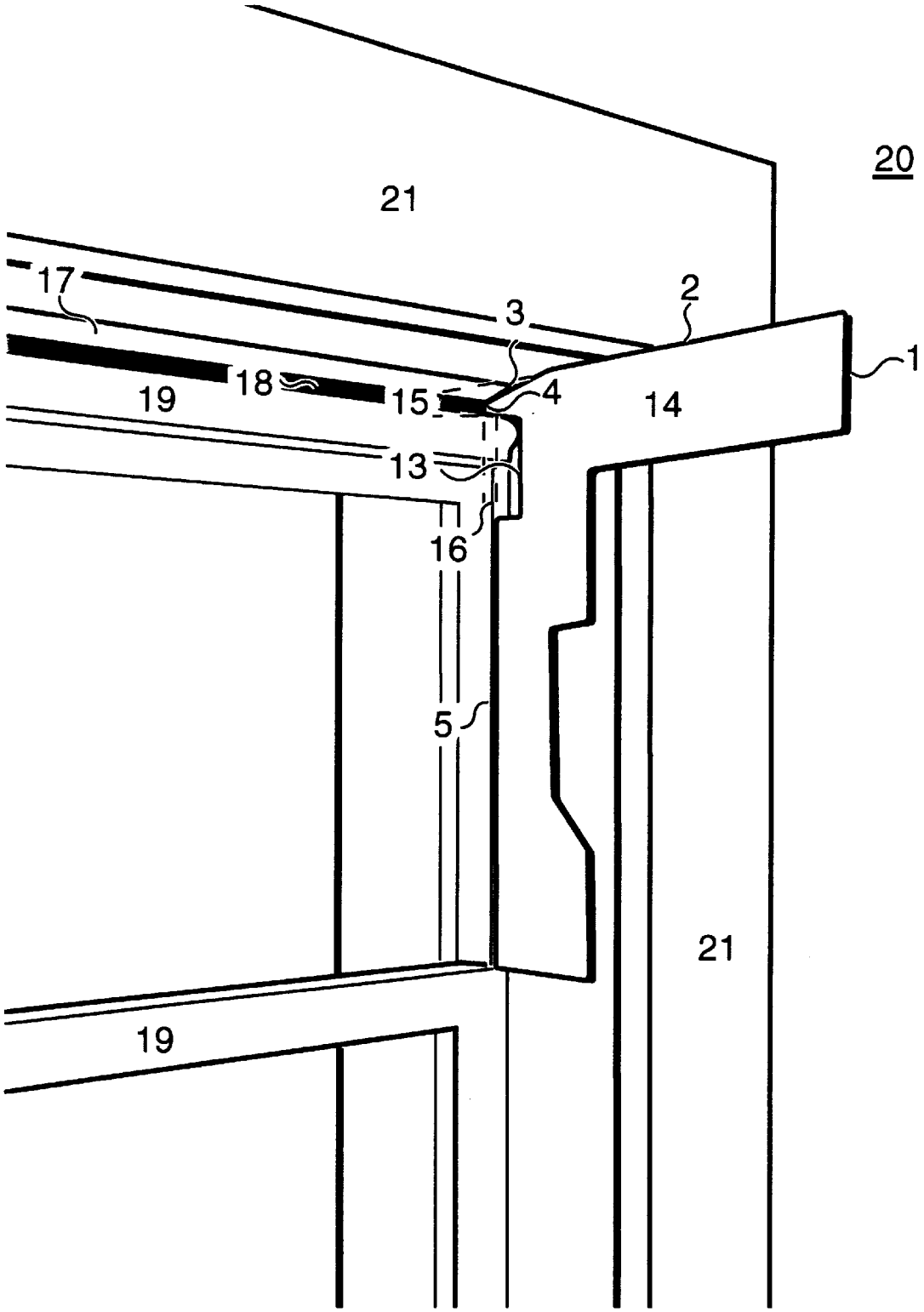
FIG. 3 is side view of the embodiment shown in FIG. 1 being used to align a window casing around a window opening for the installation of window wraps.

In general, a craftsman may use gauge 20 as follows. Assume that it is desired to wrap a rectangular shaped window opening (although a window of any symmetrical shape may be selected if desired) and that the wrapping process begins at the top right-hand side surface. As shown in FIG. 3, finger 4 of gauge 20 is inserted into a buck jamb 18 formed by the outside edge of window frame 19 and the inner edge of window buck 17. Finger 4 is preferably constructed to protrude a distance 16 (e.g., about 0.25 inches) with respect to outer leg 5 so that gauge 20 is supported by finger 4 when inserted into buck jamb 18. As shown in FIG. 3, outer leg 5 may be brought flush against a portion of window frame 19 so that gauge 20 remains self-supporting even when the weight of window casing 21 is placed on top arm 2. Eye 13 may be added to ensure that gauge 20 avoids contact with a shoulder or other protruding surface that may be near the edge of window frame 19. Furthermore, eye 13 allows gauge 20 to "jump" over window frame 19 so that outer leg 5 may be brought flush against a pane of glass within the window frame. This allows a craftsman to quickly check whether the material used to construct window casing 21 is substantially straight.

When gauge 20 is positioned as shown in FIG. 3, top arm 2 is substantially perpendicular to a major plane (not shown) that is substantially parallel to window frame 19. Nose 3 is preferably angled so that finger 4 does not interfere with a beveled edge that may be present on window buck 17. As shown in FIG. 3, gauge 20 extends outward from the window opening and provides a predetermined wrapping distance 15 (e.g., about 0.625 inches) from the outer edge of window frame 19 to top arm 2. This distance may be used to construct an interior wall structure (window casing 21) around the window opening. The purpose of window casing 21 is to establish the position of the finished interior wall relative to window frame 19 so the window opening may be wrapped before the interior walls of the building are completed. Wrapping distance 15 is chosen to be substantially equal to the thickness of the wallboard used to wrap the window plus the length of a "wrapping gap" (i.e., the space between the window wrap and casing structure that is covered by the window bead or other covering material used to finish off the resulting window jamb). Therefore, the position of top arm 2 represents the difference in thickness between window buck 17 and the window wrap plus the wrapping gap. This is the position that window casing 21 needs to be brought out to so that the window wraps, when installed, produce a substantially 90° angle at the resulting window jambs.

To illustrate this, assume the window opening shown in FIG. 3 has a 0.75 inch window buck 17. This means that the outer edge of window frame 19 is set 0.75 inches away from the inner surface of the window opening. The craftsman needs to know how far window casing 21 should extend over the interior lip of the window opening so that a certain standard-size piece of material can be used to wrap the opening. If it is desired to wrap the opening with a standard 0.5 inch wallboard and 0.125 inch window bead, for example, distance 15 is selected to be 0.625 inches. This allows gauge 20 to project the required 0.625 inch wrapping dimension out from the window opening so it can be used to offset the distance created by window buck 17. If window buck 17 is 0.75 inches, and gauge 20 provides the 0.625 inch offset, window casing 21 needs to extend the difference of these two values, i.e., 0.125 inches over the interior window lip. Gauge 20 provides this distance at top arm 2 so that the craftsman has a stable point of reference from which to construct window casing 21.

In practice, a craftsman may place gauge 20 in one corner and then lay the material used to "case" the window (shown in FIG. 3 as window casing 21) on top arm 2 and secure it in place. The process is repeated at each corner until the window opening is surrounded by window casing 21. The window wraps will now slip right into place and make a substantially 90° angle at the window jamb.

It will be apparent to those skilled in the art that wrapping distance 15 can be adjusted to accommodate virtually any size of wrapping material. For instance, in the above-described example, if it was desired to wrap the window opening with a 0.25 inch wallboard and 0.125 inch window bead, distance 15 would be set to 0.375 inches, and window casing 21 would need to extend 0.375 inches over the interior window lip.

However, if it is desired to wrap a window opening with a material that does not allow the use of window bead (e.g., wood or metal), wrapping distance 15 is chosen to be substantially equal to the thickness of the wallboard or other material used to wrap the window. This is because the window wrap and window casing need to abut one another. In this case, the position of top arm 2 represents the difference in thickness between window buck 17 and the window wrap. This is the position that window casing 21 needs to be brought out to so that the window wraps, when installed, abut window casing 21 at a substantially 90° angle.

To illustrate this, assume the window opening shown in FIG. 3 has a 0.75 inch window buck 17. This means that the outer edge of window frame 19 is set 0.75 inches away from the inner surface of the window opening. The craftsman needs to know how far window casing 21 should extend over the interior lip of the window opening so that a certain standard-size piece of material can be used to wrap the opening. If it is desired to wrap the opening with a standard 0.375 inch plywood, for example, distance 15 is selected to be 0.375 inches. This allows gauge 20 to project the required 0.375 inch wrapping dimension out from the window opening so it can be used to offset the distance created by window buck 17. If window buck 17 is 0.75 inches, and gauge 20 provides the 0.375 inch offset, window casing 21 needs to extend the difference of these two values, i.e., 0.375 inches over the interior window lip. Gauge 20 provides this distance at top arm 2 so that the craftsman has a stable point of reference from which to construct window casing 21.

It will be apparent to those skilled in the art that wrapping distance 15 can be adjusted to accommodate virtually any size of wrapping material. For instance, in the above-described example, if it was desired to wrap the window opening with a 0.25 inch plywood rather than a 0.375 inch plywood, distance 15 would be set to 0.25 inches, and window casing 21 would need to extend 0.5 inches over the interior window lip.

Other dimensions on gauge 20 can also be adjusted to accommodate a wide variety of installation parameters. For example, the angle and length of nose 3 may be varied to conform to the angle of a bevel on window buck 17. The length of finger 4 can be modified to fit into different sized buck jambs 18. For example, finger 4 may be constructed so that it comes to a point rather than a small flat surface. This configuration may be useful when wrapping DUROFRAME type windows. Distance 16 can also be altered to fit into different sized buck jambs 18. The depth and width of eye 13 can be varied depending on the size of a shoulder or other protrusion on window frame 19. The length of outer leg 5 can be modified to for use on window frames of varying sizes, etc. If desired, bucking and wrapping gauge 20 may be implemented as a separate wrapping gauge 30 (FIG. 4) and bucking gauge 40 (FIG. 5).

Figure 4:
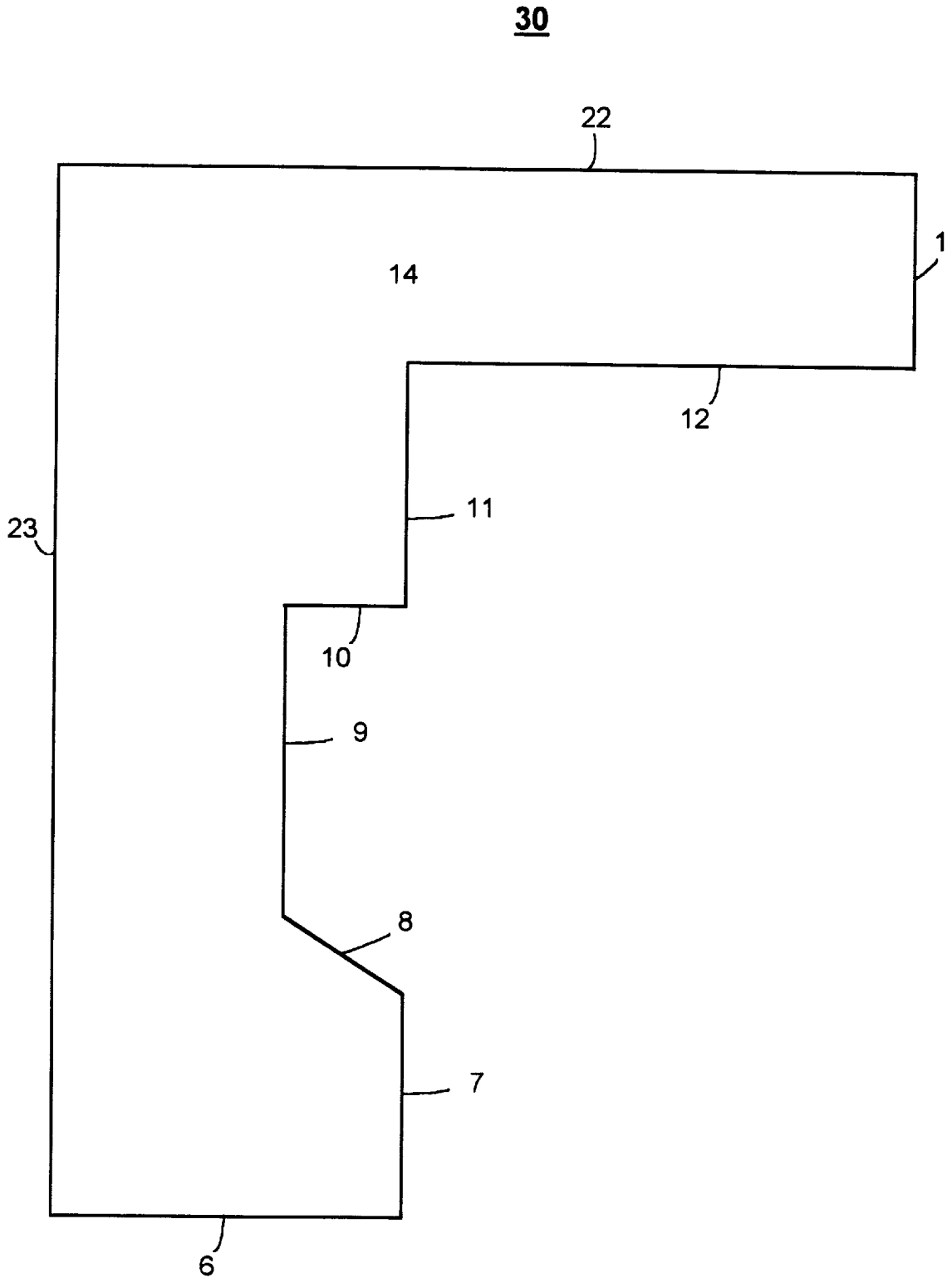
FIG. 4 is view of an alternate embodiment of the present invention configured only for bucking a window opening.

FIG. 4 shows a bucking gauge 30 constructed in accordance with the principles of the present invention. Bucking gauge 30 is similar to bucking and wrapping gauge 20 in many ways. Accordingly, substantially similar elements are numbered in bucking gauge 30 with the same reference numerals as bucking and wrapping gauge 20, and the above description applies to those elements.

As shown in FIG. 4, bucking gauge 30 includes top arm 22, outer leg 23, bottom arm 12, face 11, head 10, back 9, butt 8, and inner leg 7 and may be used to buck a window opening. Note that nose 3, finger 4, and eye 13 have been removed. Top arm 22 and outer leg 23 play no role in the bucking process and thus may be joined together at a right angle to form the outer edge of a framing square.

Figure 5:
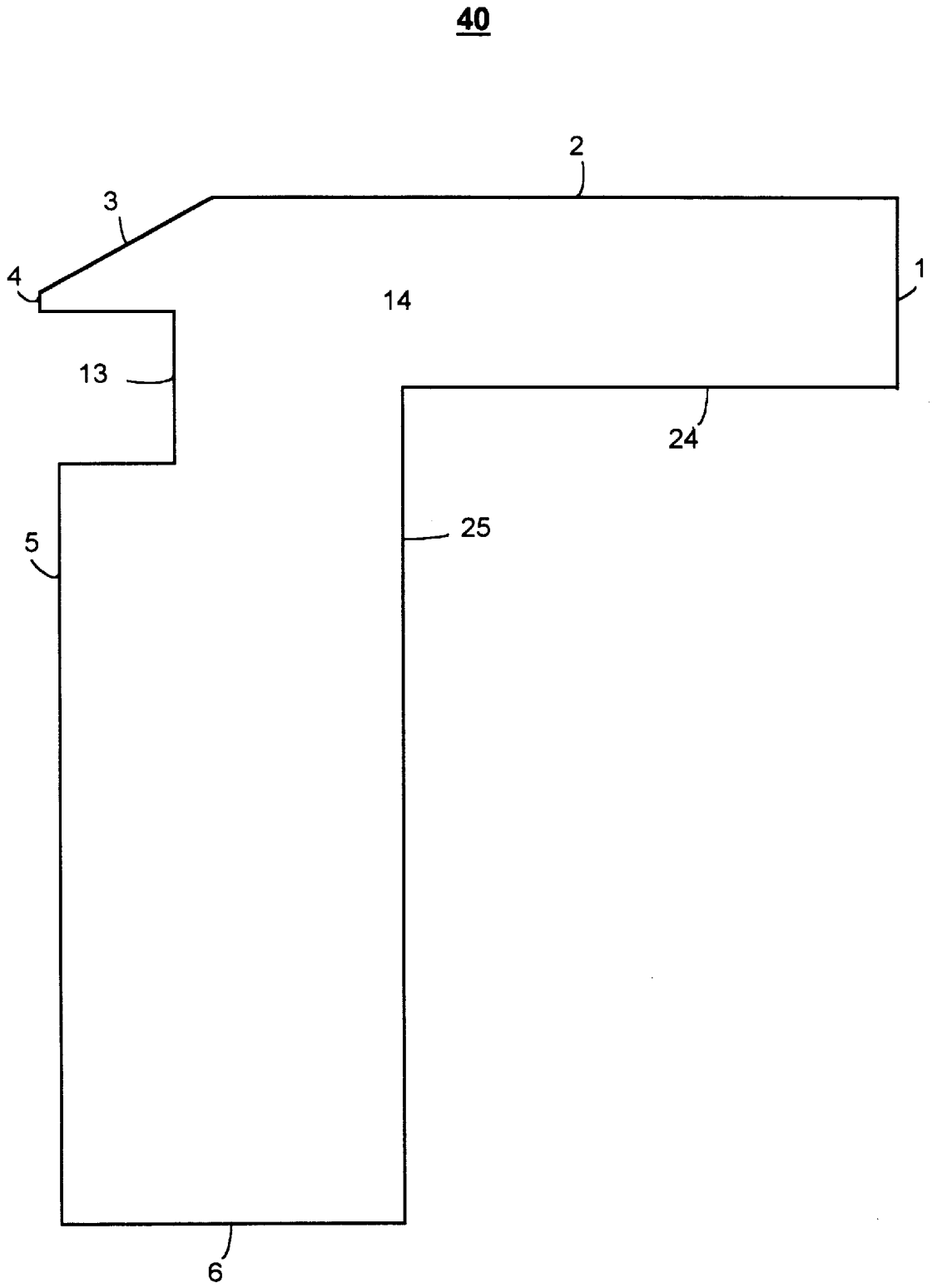
FIG. 5 is an overhead view of an alternate embodiment of the present invention configured only for wrapping a window assembly.

FIG. 5 shows a wrapping gauge 40 constructed in accordance with the principles of the present invention. Wrapping gauge 40 is similar to bucking and wrapping gauge 20 in many ways. Accordingly, substantially similar elements are numbered in wrapping gauge 40 with the same reference numerals as bucking and wrapping gauge 20, and the above description applies to those elements.

As shown in FIG. 5, wrapping gauge 40 includes ear 1, top arm 2, nose 3, finger 4, eye 13, outer leg 5, bottom arm 24, and inner leg 25 and may be used to wrap a window opening. Note that butt 8, back 9, and head 10 have been removed. Bottom arm 24 and inner leg 25 play no role in the wrapping process and thus may be joined together at a right angle to form the inner edge of a framing square.

Persons skilled in the art will appreciate that the present invention can be practiced by other than the described embodiments, which are presented for purposes of illustration and not of limitation, and the present invention is limited only by the claims which follow.

What is claimed is:

1. A substantially L-shaped, planar wrapping gauge for aligning window wraps, the wrapping gauge comprising an inside edge portion and an outside edge portion, said outside edge portion comprising:

a substantially straight outer leg portion having a longitudinal axis;

a finger portion that establishes a reference point and extends transversely past said outer leg portion;

an eye portion between said outer leg portion and said finger portion and recessed from said outer leg portion, said eye portion having a length less than said outer leg portion; and a top arm portion proximal to said finger portion and substantially perpendicular to said axis, said top arm portion providing a predetermined wrapping distance relative to said reference point in order to determine a position of an aligning plane that is substantially perpendicular to said axis and offset from said reference point by said wrapping distance.

2. The wrapping gauge of claim 1 wherein said wrapping distance is substantially equal to a thickness of a material used to wrap a window opening.

3. The wrapping gauge of claim 1 wherein said wrapping distance is substantially equal to a thickness of a material used to wrap a window opening plus a size of a wrapping gap.

4. The wrapping gauge of claim 1 further comprising a nose portion between said finger portion and said top arm portion, said nose portion being constructed at an angle relative to said top arm portion.

5. The wrapping gauge of claim 1 wherein said wrapping gauge is self-supporting when a load is placed on said top arm portion.

6. A generally L-shaped, planar bucking and wrapping gauge for aligning and installing window bucks and window wraps, comprising an inside edge portion and an outside edge portion, said inside edge portion comprising:

(a) a bottom arm portion that establishes a reference point from which a predetermined setback distance is measured;

(b) a face portion extending from the bottom arm portion and having a longitudinal axis and a length that provides said predetermined setback distance, said face portion being substantially perpendicular to said bottom arm portion; and (c) an aperture region adjacent to said face portion and situated at a distance from said bottom arm portion corresponding to said predetermined setback distance, said aperture region configured for receiving and supporting a window buck;

said outside edge portion comprising:

(a) a substantially straight outer leg portion having a longitudinal axis;

(b) a finger portion that establishes a reference point and extends transversely past said outer leg portion;

(c) an eye portion between said outer leg portion and said finger portion and recessed from said outer leg portion, said eye portion having a length less than said outer leg portion; and (d) a top arm portion proximal to said finger portion and substantially perpendicular to said axis of said outer leg portion, said top arm portion providing a predetermined wrapping distance relative to said reference point established with said finger portion in order to determine a position of an aligning plane that is substantially perpendicular to said axis of said outer leg portion and offset from said reference point established with said finger portion by said wrapping distance.

7. The gauge of claim 6 wherein said wrapping distance is substantially equal to a thickness of a material used to wrap a window opening.

8. The gauge of claim 6 wherein said wrapping distance is substantially equal to a thickness of a material used to wrap a window opening plus a size of a wrapping gap.

9. The gauge of claim 6 further comprising a nose portion between said finger portion and said top arm portion, said nose portion being constructed at an angle relative to said top arm portion.

10. The gauge of claim 6 wherein said aperture region further comprises a head portion having a length and being substantially perpendicular to said face portion, said length of said head portion determining a depth of said aperture region.

11. The gauge of claim 6 wherein said aperture region further comprises a back portion substantially parallel to and recessed from said longitudinal axis of said face portion.

12. The gauge of claim 11 wherein said aperture region further comprises a butt portion adjacent to said back portion, said butt portion being constructed at an angle.

* * * * *